US005980156A

United States Patent [19]

Morello et al.

[11] Patent Number: 5,980,156

[45] Date of Patent: Nov. 9, 1999

[54] TUNNEL LINER BUILDING METHOD AND BUILDING PANELS THEREFOR

[75] Inventors: Frederick Morello; David B. Berkey, both of Johnstown, Pa.

[73] Assignee: M. I. C. Industries, Inc., Reston, Va.

[21] Appl. No.: 09/092,984

[22] Filed: Jun. 8, 1998

[51] Int. Cl.[6] ..... E21D 11/00; E04D 1/00

[52] U.S. Cl. ..... 405/151; 52/528; 52/539; 405/124; 405/150.1

[58] Field of Search ..... 405/274–281, 405/124–126, 151–153, 150.1; 24/457, 563, 293; 52/539, 537, 319, 592.1; 403/329

[56] References Cited

U.S. PATENT DOCUMENTS

| | | | |
|---|---|---|---|
| 3,706,172 | 12/1972 | Keith | 52/539 X |
| 4,224,775 | 9/1980 | Heckelsberg | 52/528 |
| 4,312,166 | 1/1982 | Mock | 405/281 X |
| 4,674,921 | 6/1987 | Berger | 405/281 X |
| 4,694,628 | 9/1987 | Vondergoltz et al. | 52/528 |
| 5,022,207 | 6/1991 | Hartnett | 52/537 |
| 5,393,173 | 2/1995 | Morello . | |
| 5,519,974 | 5/1996 | Greeberg | 52/518 |
| 5,675,955 | 10/1997 | Champagne | 52/539 X |
| 5,725,638 | 3/1998 | Cross et al. | 24/563 X |

*Primary Examiner*—Dennis L. Taylor
*Attorney, Agent, or Firm*—Rothwell, Figg, Ernst & Kurz PC

[57] ABSTRACT

Tunnel liners are formed from panels of arched sheet material. The panels include a central portion, inclined side portions and wing portions. One of the wing portions has a hook portion and the other of the wing portions has a receptacle portion. The hook portions and receptacle portions are constructed so as to snap-fit with respective receptacle portions and hook portions of adjacent panels. Panels can thus be more easily be assembled together. Panels can also be continuously seamed together from the underside, i.e., from within an arched assembly of panels.

37 Claims, 6 Drawing Sheets

TUNNEL LINER BUILDING METHOD AND BUILDING PANELS THEREFOR

BACKGROUND OF THE INVENTION

1. Field of The Invention

This invention relates to the art of forming tunnel liners and particularly to improvements for forming such tunnel liners with panels of arched sheet-metal material, and includes a unique method of building such tunnel liners and unique panels and assemblies of panels.

2. Background And Prior Art

Machines which form bendable materials, such as sheet-metal, into panels and curve the panels for making continuous arched buildings or roofs for buildings by seaming the panels together are known in the art. Such machines are commercially available from M.I.C. Industries, Inc., of Reston, Va. and are shown, at least partially, in U.S. Pat. Nos. 3,842,647, 3,902,288, 3,967,430, and 4,364,253, all owned by M.I.C. Industries, Inc., the present assignee. In this prior art, the panels formed from sheeted steel or the like are used with a seaming apparatus which operates from the top of the structure to seam adjacent panels and to secure these panels together.

A problem exists with the prior art described above when attempting to construct a structure within a closed space, such as a lining for a tunnel, or when a distance between the top of the panels and the existing structure is so limited that seaming cannot be accomplished.

U.S. Pat. No. 5,393,173, also owned by M.I.C. Industries, Inc., shows a tunnel liner building method and building panels therefor that among other things overcame certain problems in the above-noted prior art. The '173 patent teaches the formation of tunnel liners from panels of arched, bendable sheet material. In the '173 patent, panels 10 include a central portion 12, inclined side portions 14 and 16, wing portions 18 and 20, and a hook portion 22 and a receptacle portion 28 at opposite sides of each panel 10. In the '173 patent, the panels can be joined with the hook portion of one panel fitting into the receptacle portion of the other panel and then continuously seamed from the underside, i.e., the inside of the arched assembly.

There are, however, limitations in the '173 device, and there exists a need for an improved tunnel liner building method and building panels therefor. Among other limitations, the seaming method of the '173 patent can result in difficulties during assembling.

SUMMARY OF THE INVENTION

The present invention provides an improved tunnel liner structure, panel, and building method in which curved continuous arched panels of bendable sheetmetal material that can be "snapped" together from the underside of the structure.

One benefit of the present invention over the structure of the '173 patent is that the present invention allows the panels to be "snapped" together, as opposed to requiring the panels to be "seamed" together for attachment.

Nevertheless, according to the present invention, a seamer can still be used to further tighten the snap connection after the panels are snapped together.

According to a first aspect of the invention, a plurality of tunnel liner building panels are provided that each include: a central main portion; a pair of inclined side wall portions, one on each side of the main portion, and extending at an inclined angle to the main portion; wing portions extending from each of the inclined side wall portions, the wing portions being generally parallel to the main portion; a hook portion on one side the panel extending from one of the wings; a receptacle portion on the other side of the panel extending from the end of the other wing; two adjacent panels being snap-fittable side-by-side by snapping the receptacle portion into the hook portion to provide a continuous seam between adjacent panels.

According to another aspect of the invention, a method of forming tunnel liners includes: forming the above panels into an arched curved-shaped, in situ; assembling several of the panels together on the ground with the hook side of one panel adjacent the receptacle side of the adjacent panel; snapping the panels together; and erecting the panels. A seam can also be made from the underside of the panel.

Preferably, a set of two or three panels is snapped together and then erected. Then, an additional set is similarly erected. Then, the erected sets are snapped together. In addition, the snapped together panels can also be seamed together with a seamer, either prior to erecting a set of panels or after that set of panels is erected. The erected sets are preferably in sets of three panels. In the preferred method, all of the required assembly of the panels is performed from underneath the panels.

BRIEF DESCRIPTION OF THE DRAWINGS

The present invention is illustrated by way of example and not limitation in the accompanying drawings, in which like references indicate like parts, and in which.

DETAILED DESCRIPTION OF PREFERRED EMBODIMENT

Figure 1:
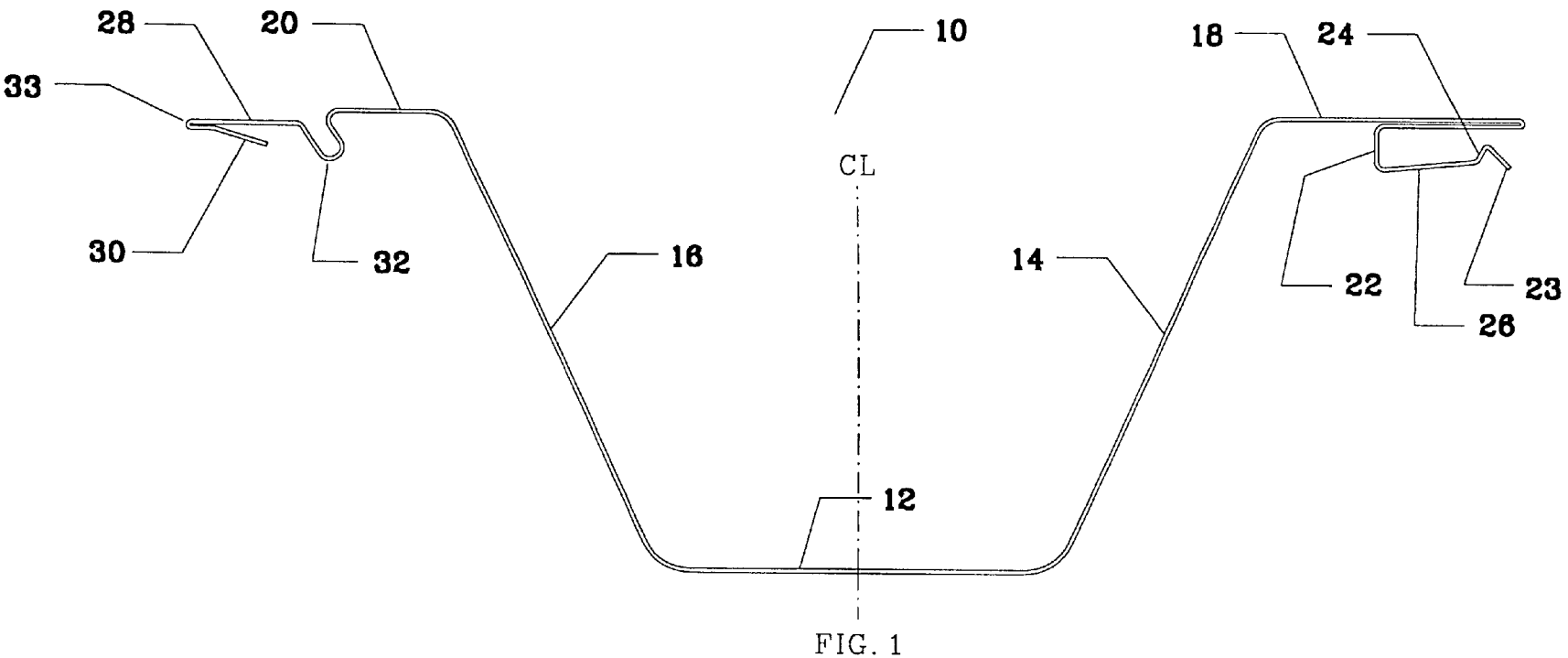
FIG. 1 is a cross-sectional view of a preferred form of the tunnel liner panel according to a preferred embodiment of this invention.

In the preferred embodiment of the invention, as shown in FIG. 1, a panel 10 is formed and curved to provide an arched-shaped panel of which FIG. 1 is a cross section.

Figure 4:
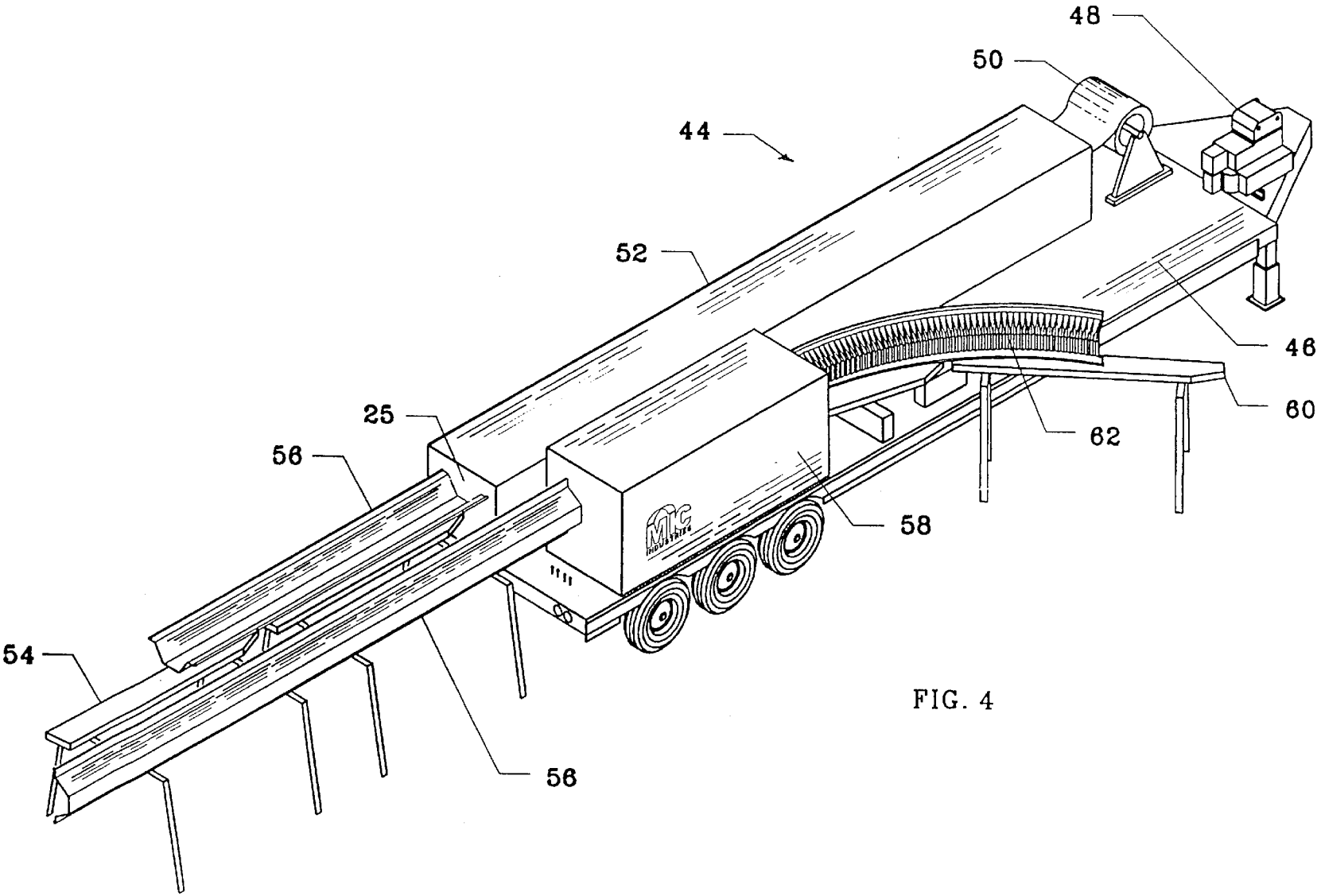
FIG. 4 is a perspective view of a panel forming and curving machine used for forming the panels of this invention.

The panels are preferably formed automatically, and preferably on site (i.e., at a site utilizing the panels). As shown in FIG. 4, preferably, a mobile machine 44 is provided that is mounted on a trailer 46 and that has components powered via an engine 48. As is known in the art, a coil of metal 50, e.g., steel, is placed on a machine and runs through a forming section 52 to form the panel. (In the present invention, the panel is preferably formed to have a shape as shown in FIG. 1.) A run-out table 54 is provided for receiving the formed panel and after the desired length of panel is formed, it is cut off by a guillotine shear on the machine (not shown). The formed panel is then turned sideways on the run-out table and fed back through a curving station 58, which curves the formed panel 62. In general, such a mobile machine for forming and bending sheet-metal into formed, curved panels is commercially available from M.I.C. Industries, Inc., of Reston, Va.

The preferred panel structure is shown in FIG. 1. As shown, the panel 10 has a main central portion 12 off of which a pair of inclined side portions 14 and 16 extend at inclined angles. At opposite sides of the panel, wing portions 18 and 20 extend from the upper ends of the inclined side portions and parallel to the main central portion 12. At the end of the wing portion 18, a hook portion 22 is provided which includes inclined outer and inner hook walls 23 and 24, respectively, and a hook base portion 26. The hook base portion 26 has a lower wall that is preferably generally parallel to the wing 18 and to the main central portion 12.

At the end of the wing 20, a complimentary receptacle portion 28 is provided for receiving the hook portion 22. The outer hook wall 23 operates as a ramp to receive the hem 33. The receptacle portion 28 includes an inclined wall 30 extending from the hem 33. When adjacent panels are snapped together, contact between the inclined wall 30 and the hook wall 23 causes the hook portion 22 to flex outward and/or the inclined wall 30 to flex inward. Then, the hook snaps over the end of the wall 30, and the inclined wall locks against the wall 24. The intermediate section 32 operates as stop once the hook section 22 is seated, see, e.g., FIG. 6.

Figure 6:
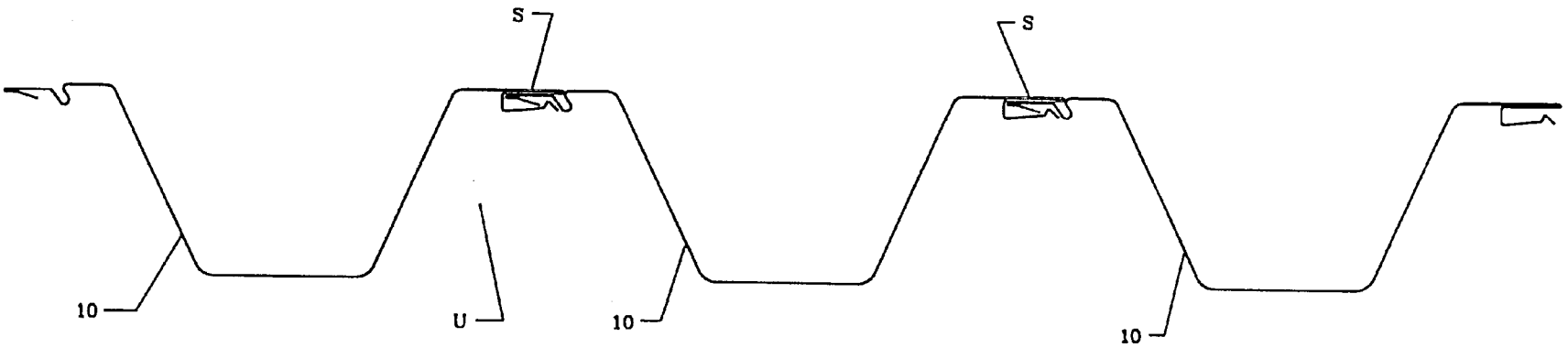
FIG. 6 is a cross-sectional view of three panels illustrating the seaming stages.

With this construction, the panels can thus be readily snapped together. FIG. 6 depicts three panels 10 snapped together in a side-by-side relationship. FIG. 6 depicts how the seam areas S of the panels look once they are snapped together.

Figure 5:
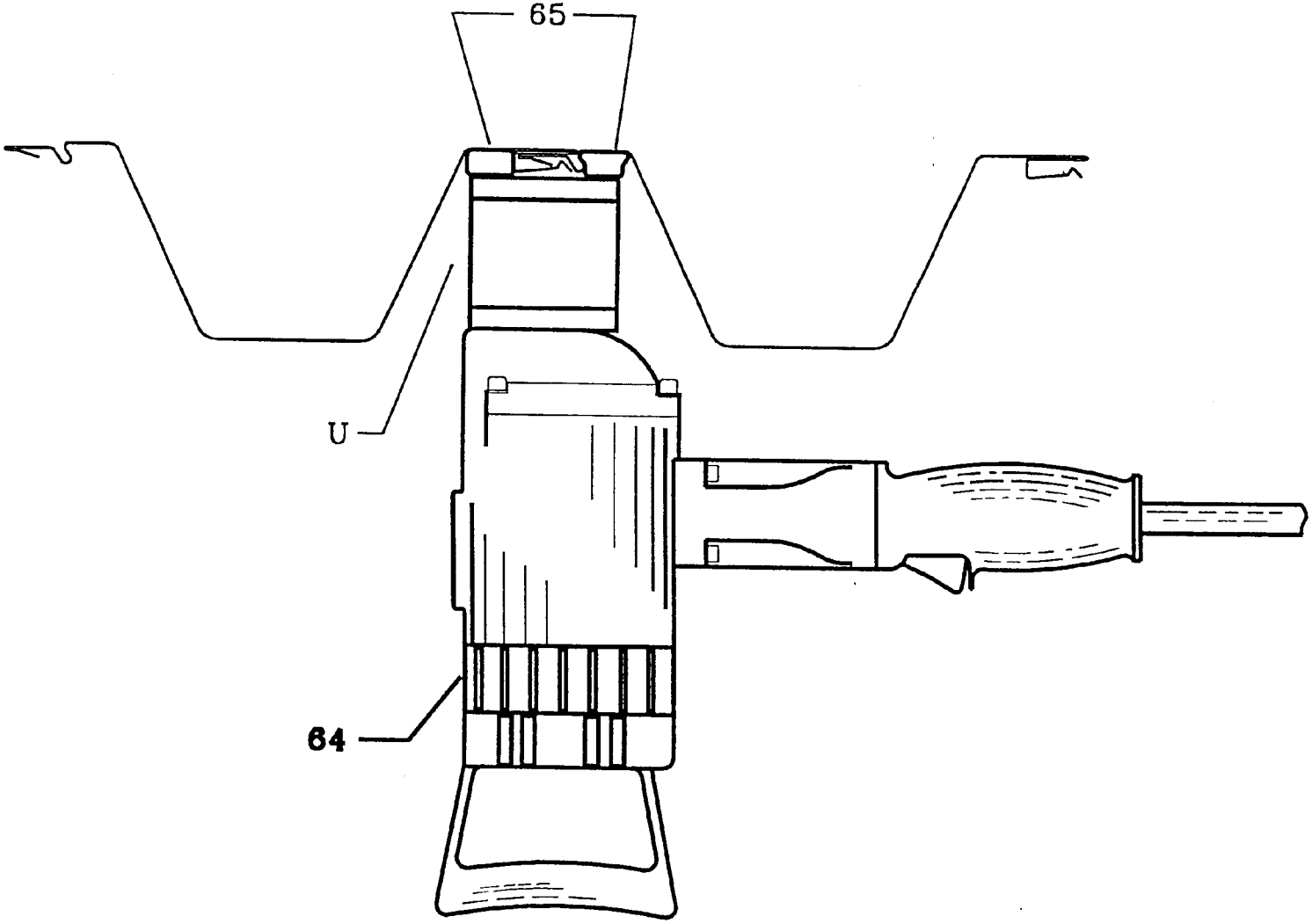
FIG. 5 is an elevational view illustrating the step of seaming adjacent panels together once the panels are snapped together according to this invention.

Once the adjacent panels are snapped together, the panels may also be seamed together using a seaming device, or seamer, 64 such as shown in FIG. 5. The seamer 64 can be of any type generally known for seaming metal panels. The seamer can include, for example, four-seaming rollers 65 that operate to seam the panel in a known manner. The seamer 64 can be run continuously from one side of the arched panel to the other on the underside U of the curved panel. The underside can be, for example, a location inside a tunnel, etc.

Figure 2:
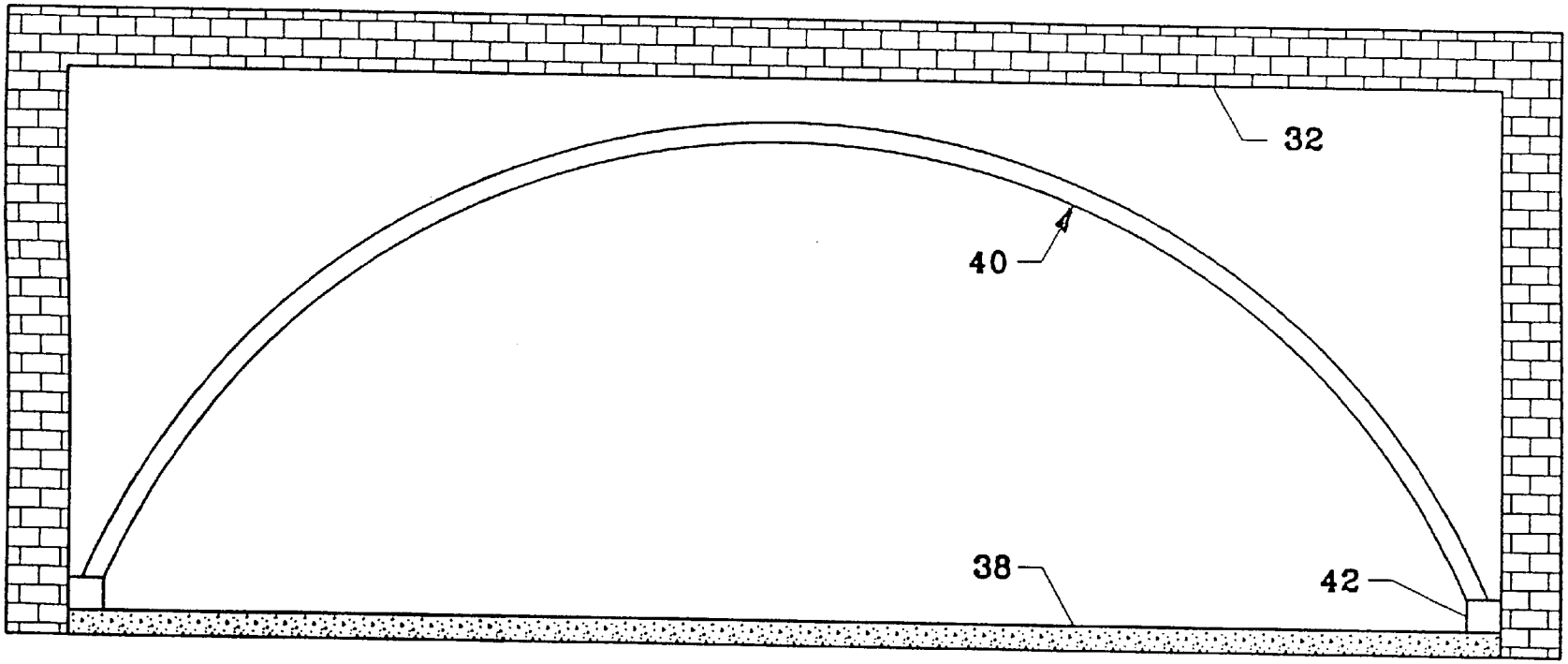
FIG. 2 is an end view illustrating the use of tunnel liners of this invention in lining a tunnel having a rectangular section.
Figure 3:
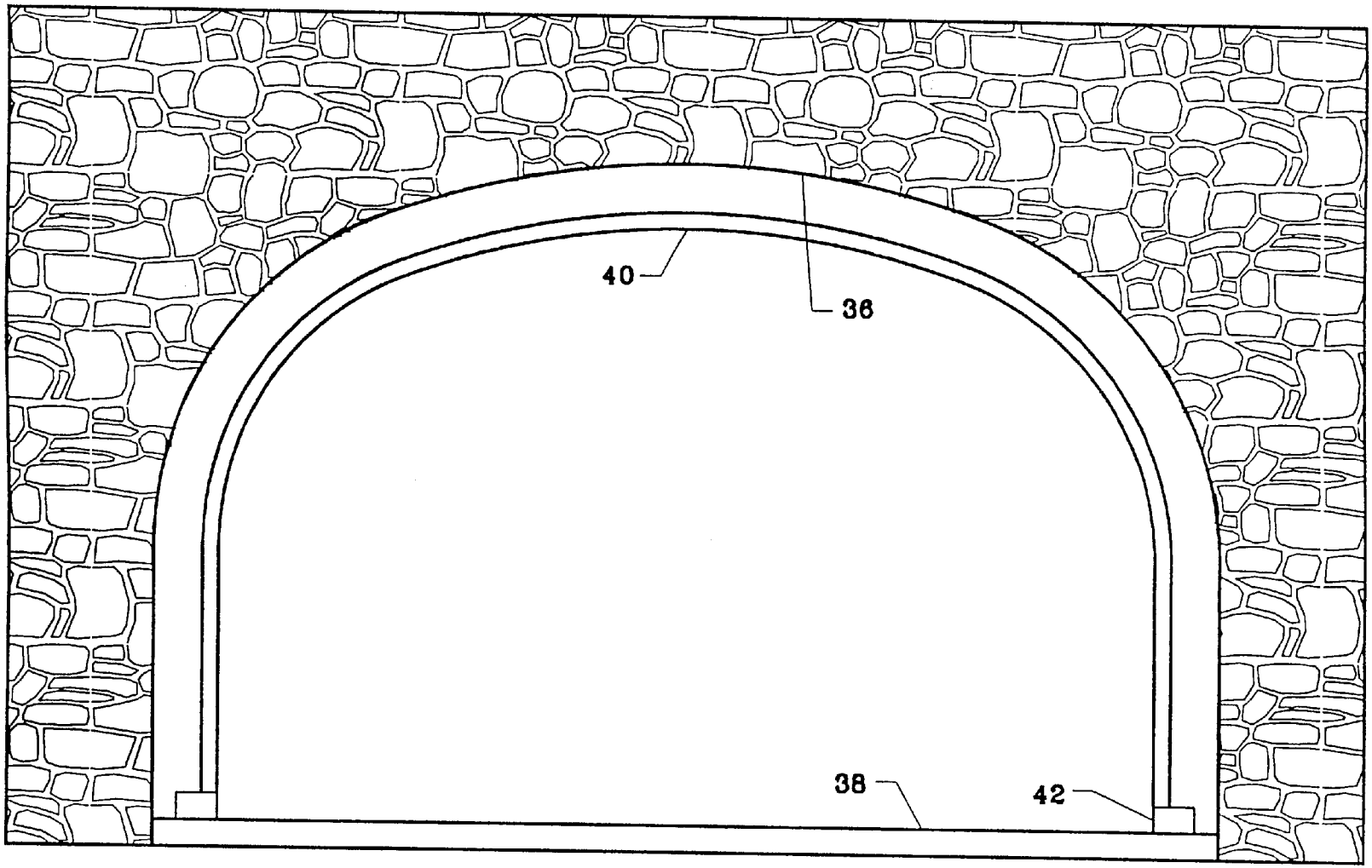
FIG. 3 is an end view illustrating the use of tunnel liners of this invention for lining a tunnel having an arched-shaped section.

This is particularly advantageous in situations where access to the top of the panel, such as on top of a tunnel liner is impossible, such as shown for example in FIGS. 2 and 3. FIG. 2 shows an example wherein tunnel walls 32 are constructed that have a generally rectangular cross-sectional shape extending over a roadway 38. A plurality of assembled curved seamed panels 10 can be used to form a tunnel liner 40. Seaming can take place on the underside U or inside of the tunnel liner and the tunnel liner can be placed in a suitable foundation 42 to provide a completely self-supporting liner. In addition, FIG. 3 shows a similar example wherein the tunnel walls 36 are arched-shaped, since there is also likely to be insufficient space above the tunnel liner 40 to accomplish seaming.

The panels 10 each preferably have generally equal cross-sections on both sides of the center line CL, FIG. 1, to provide a more stable structure when completed. In other words, tension and compression forces acting within the panel are thus equal and opposite each other and provide a more balanced structure.

Existing tunnel liners provide adequate protection only for a limited amount of time, but with the present invention, the life of the tunnel liner is limited only by the life of the metal used which of course could be stainless steel, galvanized steel, aluminum, or the like. Additionally, lights or other elements can be integrated into the inside of the tunnel liner.

A preferred method of assembling the panels includes assembling individual sets of two or three panels as they lay on their side on the ground. Thereafter, a set of panels can be up-righted and adjoined to another set of previously assembled and up-righted panels. Any seaming that needs to be performed can be after the panels are up-righted. Alternatively, it is contemplated that the panels could also be seamed together as they lay on their sides.

The present invention, thus, provides a water-tight seal so that any moisture or weather environments from inside the tunnel structure travel along the outside of the tunnel liner to an appropriate drainage system. When finally completed, the tunnel liner provides an adequate surface in which lights and other fixtures can be applied underneath, with sheet-metal screws if desired through the under turned flange assembly. Because the under-turned flange assembly is not exposed to the environment, no leakage would come through the screw holes. The seam will. thus not provide a leak path.

In one exemplary method of assembling the panels, a set of, for example, three panels can be snapped together. Then, the set can be up-righted from a ground position to an erected position by, for example, a crane device which is attached to the underside of the panels. Once up-righted, the panels may be tied in position with ropes until enough panels are assembled that they become self-supporting. The process can continue in groups of three panels until the structure is completed. Assembling in groups of three gives the tunnel liner the ability to approach curves and tunnels, such as car tunnels, which may have curved portions. The design of this invention thus allows the panels to be curved so as to make gradual turns within a tunnel.

Although this invention has been described with a degree of particularity in regarding to the preferred embodiments, it is understood that this is only by way of example, and changes in detail structure may be made without departing from the spirit of the invention. It is the intention, therefore, to be limited only by the scope of the appended claims.

What is claimed is:

1. An assembly, comprising:

a) a plurality of arched panels positioned side-by-side;

b) each of the panels being constructed of an elongated sheet of bendable sheet metal material having as viewed in a lengthwise direction a central portion, a pair of inclined side wall portions, said side wall portions being connected at opposite sides of said central portion and extending at an angle to said central portion so as to form a generally U-shape with said central portion, a pair of wing portions connected to said inclined side wall portions and extending outwardly therefrom in a plane generally parallel to said central portion, a hook portion extending from one of said wing portions, a receptacle portion extending from the other of said wing portions;

c) at least one of said arched panels having its corresponding receptacle portion snap-fit together to form a snap-fit connection with a respective hook portion of an adjacent one of said arched panels, said snap-fit connection being located at a concave side of said arched panels so as to be accessed from said concave side of said arched panels.

2. The assembly of claim 1, wherein said hook portion includes an outer wall that is positioned to operate as a ramp to facilitate insertion into the receptacle portion and an inner wall that is positioned to operate as a lock to deter removal from the receptacle portion after insertion into said receptacle portion.

3. The assembly of claim 1, wherein said receptacle portion includes an outer hem portion and an inclined wall that extends towards a center of the panel.

4. The assembly of claim 2, wherein said receptacle portion includes an outer hem portion and an inclined wall that extends towards a center of the panel.

5. An assembly including a plurality of arched panels, each panel comprising:

a) a central main portion;

b) a pair of inclined side wall portions, one on each side of and connected to the central main portion and extending at an inclined angle to a plane of the main portion;

c) a hook portion extending from one of the side wall portions laterally in a direction generally parallel to a plane of said central main portion;

d) a receptacle portion extending from the other of the side wall portions with an opening facing in a direction substantially opposite to said direction of said hook portion;

e) at least one of said hook portion and said receptacle portion having an inclined wall configured to cause that portion to flex in a direction generally perpendicular to said plane of said central main portion upon being snapped together with the other of said hook portion and said receptacle portion of an adjacent panel.

6. The assembly of claim 5, wherein each of said panels further includes a pair of wing portions connected to the inclined side wall portions and extending outwardly therefrom in a plane generally parallel to the main portion, the wing portions having the hook and receptacle portions extending therefrom.

7. The assembly of claim 6, wherein said hook portion includes an outer wall that is positioned to operate as a ramp to facilitate insertion into the receptacle portion and an inner wall that is positioned to operate as a lock to deter removal from the receptacle portion, and wherein said receptacle portion includes an outer hem portion and an inclined wall that extends towards a center of the panel.

8. A method of constructing an assembly having arched panels of bendable sheet metal material, comprising the steps of:

a) forming a plurality of arched elongated panels of bendable sheet metal material with each panel having a central portion, a pair of inclined sides extending upward from opposite sides of said central portion to form a generally U-shape with said central portion, a hook on one side of said U-shape and a receptacle on the other side of said U-shape, as viewed in a lengthwise direction of each said panel, said arched panels being arched generally around an axis perpendicular to the lengths of said panels;

b) placing the panels in side-by-side relationship with the hook of one panel adjacent the receptacle of an adjacent panel; and c) forcing said panels together in a direction generally parallel to said axis to cause at least one of said hook and said receptacle to flex and snap together with the other of the hook and the receptacle of the adjacent panel.

9. The method of claim 8, further including the steps of snapping together a first set of a plurality of panels side-by-side on the ground, erecting said first set of panels, snapping together a second set of a plurality of panels side-by-side on the ground, erecting said second set of panels adjacent said first set of erected panels, and snapping together said first and second sets of erected panels.

10. The method of claim 9, further including the step of seaming at least some of said panels together further with a seamer in order to further tighten said panels together.

11. The method of claim 9, wherein said step of seaming includes seaming panels that are on the ground prior to being erected.

12. The method of claim 10, wherein said step of seaming includes seaming panels that have already been erected.

13. The assembly of claim 1, wherein said arched panels form a tunnel liner.

14. The assembly of claim 1, further including an obstruction on an outer convex side of said arched panels such that access to a top of said arched panels is inhibited.

15. The assembly of claim 14, wherein said obstruction is tunnel wall and said arched panels form a tunnel liner.

16. The assembly of claim 1, wherein said hook portion and said receptacle portion are formed proximate undersides of said wing portions so as to be located on an underside of said arched panels.

17. The assembly of claim 1, wherein said hook portion includes a portion of said sheet metal at an outer end of the respective wing portion that is folded under to create said hook portion.

18. The assembly of claim 1, wherein said receptacle portion includes a portion of said sheet metal at an outer end of the respective wing portion that is folded under to create said receptacle portion.

19. The assembly of claim 16, wherein said snap-fit together hook portion and receptacle portion are seamed together.

20. The assembly of claim 16, further including at least one fixture attached to the underside of said panels at said snap-fit together hook portion and receptacle portion.

21. The assembly of claim 20, wherein said fixture include at least one light.

22. The assembly of claim 1, wherein said panels each have generally equal cross-sections on both sides of center lines extending lengthwise through said panels.

23. The assembly of claim 1, wherein the arch of said arched panels forms a generally inverted U-shape.

24. The assembly of claim 23, wherein said arch has generally flat side portions and a curved top portion.

25. The assembly of claim 24, wherein said generally flat side portions are generally vertical.

26. The assembly of claim 1, wherein said arch has a generally curved shape over substantially the entire arch.

27. The method of claim 8, further including the step of providing said arched panels as a tunnel liner within a tunnel.

28. The method of claim 8, further including the step of assembling said arched panels beneath an obstruction over the outer convex side of said arched panels such that access to a top of said arched panels is inhibited.

29. The method of claim 28, further including the steps of providing said obstruction as an inside of a tunnel and providing said arched panels as a tunnel liner for said tunnel.

30. The method of claim 8, further including the step of providing said hook portions and said receptacle portions at the concave undersides of said arched panels so as to be accessed from underneath said arched panels.

31. The method of claim 30, further including the step of providing said arched panels as a tunnel liner within a tunnel.

32. The method of claim 30, further including the step of seaming together said snap-fit connection between said hook portion and said respective receptacle portion.

33. The method of claim 32, wherein said step of seaming together includes seaming with a seamer from a location underneath said arched panels.

34. The method of claim 30, further including the step of attaching at least one fixture to the underside of said panels at said snap-fit hook portion and receptacle portion.

35. The method of claim 34, wherein said fixture includes at least one light.

36. The method of claim 30, wherein said step of providing said hook portions and said receptacle portions at the concave undersides of said arched panels includes forming a wing portion that is folded under to create said hook portion and forming a wing portion that is folded under to create said receptacle portion.

37. The method of claim 8, further including the step of forming said panels to each have generally equal cross-sections on both sides of center lines extending lengthwise through said panels so as to balance tension and compression forces within the panels.

* * * * *